US012071837B2

(12) United States Patent
Tessier et al.

(10) Patent No.: US 12,071,837 B2
(45) Date of Patent: Aug. 27, 2024

(54) METHODS OF PROVIDING WELLBORES FOR ELECTROMAGNETIC HEATING OF UNDERGROUND HYDROCARBON FORMATIONS AND APPARATUS THEREOF

(71) Applicant: Acceleware Ltd., Calgary (CA)

(72) Inventors: Lynn P. Tessier, Calgary (CA); Shane Matthews, Calgary (CA); Michal M. Okoniewski, Calgary (CA)

(73) Assignee: Acceleware Ltd., Calgary (CA)

( * ) Notice: Subject to any disclaimer, the term of this patent is extended or adjusted under 35 U.S.C. 154(b) by 0 days.

(21) Appl. No.: 18/012,092

(22) PCT Filed: Jun. 17, 2021

(86) PCT No.: PCT/CA2021/050829
§ 371 (c)(1),
(2) Date: Dec. 21, 2022

(87) PCT Pub. No.: WO2021/258191
PCT Pub. Date: Dec. 30, 2021

(65) Prior Publication Data

US 2023/0235651 A1 Jul. 27, 2023

Related U.S. Application Data

(60) Provisional application No. 63/043,176, filed on Jun. 24, 2020.

(51) Int. Cl.
*E21B 36/04* (2006.01)
*E21B 17/02* (2006.01)
*E21B 43/24* (2006.01)

(52) U.S. Cl.
CPC ..... *E21B 43/2401* (2013.01); *E21B 17/023* (2013.01)

(58) Field of Classification Search
CPC ..... E21B 43/114; E21B 36/04; E21B 43/2401
(Continued)

(56) References Cited

U.S. PATENT DOCUMENTS 849,524 A * 4/1907 Baker ..... E21B 43/2401 588/253
2,757,738 A 8/1956 Ritchey
(Continued)

FOREIGN PATENT DOCUMENTS

CA 2612731 A1 1/2007
CA 2816101 A1 5/2012
(Continued)

OTHER PUBLICATIONS

International Search Report and Written Opinion mailed Aug. 30, 2021 in International Patent Application No. PCT/CA2021/050829 (8 pages).

*Primary Examiner* — Kenneth L Thompson
(74) *Attorney, Agent, or Firm* — BERESKIN & PARR LLP/ S.E.N.C.R.L. s.r.l; Isis E. Caulder; Maria Wei

(57) ABSTRACT

Methods for providing wellbores for electromagnetic heating of a hydrocarbon formation positioned below a ground surface and apparatus thereof are provided. The apparatus includes two or more wellbore casings positioned within two or more wellbores. The two or more wellbores extend from a proximal end at the ground surface to a distal end at the underground hydrocarbon formation. Each of the two or more wellbore casings have a proximal portion and a distal portion. The two or more wellbores are in proximity to one another at a junction. The apparatus also includes a first electrical connection between the proximal portions of the two or more wellbore casings for grounding the two or more wellbore casings and a second electrical connection between the distal portions of the two or more wellbore casings. The second electrical connection is located at the junction and
(Continued)

provides a short circuit that reduces current traveling on the two or more wellbore casings to the ground surface.

25 Claims, 11 Drawing Sheets

(58) Field of Classification Search
USPC ..... 166/302, 60
See application file for complete search history.

(56) References Cited

U.S. PATENT DOCUMENTS

| | | | | |
|---|---|---|---|---|
| 3,103,975 | A | 9/1963 | Hanson | |
| 3,757,860 | A | 9/1973 | Pritchett | |
| 4,135,579 | A | 1/1979 | Rowland et al. | |
| 4,140,179 | A | 2/1979 | Kasevich et al. | |
| 4,140,180 | A | 2/1979 | Bridges et al. | |
| 4,144,935 | A | 3/1979 | Bridges et al. | |
| 4,193,451 | A | 3/1980 | Dauphine | |
| 4,301,865 | A | 11/1981 | Kasevich et al. | |
| 4,319,632 | A | 3/1982 | Marr, Jr. | |
| 4,320,801 | A | 3/1982 | Rowland et al. | |
| 4,449,585 | A | 5/1984 | Bridges et al. | |
| 4,470,459 | A | 9/1984 | Copland | |
| 4,487,257 | A | 12/1984 | Dauphine | |
| 4,508,168 | A | 4/1985 | Heeren | |
| 4,513,815 | A | 4/1985 | Rundell et al. | |
| 4,579,391 | A * | 4/1986 | Mouat | E21B 43/2401 299/8 |
| 4,821,798 | A | 4/1989 | Bridges et al. | |
| 5,131,465 | A | 7/1992 | Langston | |
| 5,293,936 | A | 3/1994 | Bridges | |
| 5,402,851 | A | 4/1995 | Baiton | |
| 6,189,611 | B1 | 2/2001 | Kasevich | |
| 6,631,761 | B2 * | 10/2003 | Yuan | E21B 43/2401 392/301 |
| 7,891,421 | B2 | 2/2011 | Kasevich | |
| 8,453,739 | B2 | 6/2013 | Parsche | |
| 8,536,497 | B2 | 9/2013 | Kim | |
| 8,648,760 | B2 | 2/2014 | Parsche | |
| 8,763,691 | B2 | 7/2014 | Parsche | |
| 8,789,599 | B2 | 7/2014 | Parsche | |
| 9,394,772 | B2 * | 7/2016 | Meurer | E21B 36/04 |
| 9,574,430 | B2 * | 2/2017 | Diehl | E21B 43/2401 |
| 9,739,122 | B2 * | 8/2017 | Symington | E21B 43/2401 |
| 10,087,715 | B2 * | 10/2018 | Behr | E21B 43/305 |
| 10,443,364 | B2 | 8/2019 | Parrella et al. | |
| 10,760,392 | B2 * | 9/2020 | Okoniewski | E21B 36/04 |
| 11,359,473 | B2 | 6/2022 | Okoniewski et al. | |
| 2011/0042063 | A1 | 2/2011 | Diehl et al. | |
| 2011/0146981 | A1 | 6/2011 | Diehl | |
| 2011/0303423 | A1 | 12/2011 | Kaminsky et al. | |
| 2012/0118565 | A1 | 5/2012 | Trautman et al. | |
| 2013/0192825 | A1 | 8/2013 | Parsche | |
| 2014/0131032 | A1 | 5/2014 | Dittmer | |
| 2014/0224472 | A1 | 8/2014 | Parsche | |
| 2014/0290934 | A1 | 10/2014 | Parsche | |
| 2015/0211336 | A1 | 7/2015 | Wright et al. | |
| 2016/0047213 | A1 | 2/2016 | Grounds, III et al. | |
| 2017/0175505 | A1 | 6/2017 | Curlett | |
| 2019/0145235 | A1 | 5/2019 | Okoniewski et al. | |

FOREIGN PATENT DOCUMENTS

| | | | |
|---|---|---|---|
| CA | 2955280 | A1 | 1/2016 |
| CA | 2816297 | C | 5/2017 |
| EP | 1779938 | A2 | 5/2007 |
| WO | 2012067769 | A2 | 5/2012 |
| WO | 2017177319 | A1 | 10/2017 |

* cited by examiner

METHODS OF PROVIDING WELLBORES FOR ELECTROMAGNETIC HEATING OF UNDERGROUND HYDROCARBON FORMATIONS AND APPARATUS THEREOF

CROSS-REFERENCE TO RELATED APPLICATION

This application is a 35 USC § 371 national stage entry of International Patent Application No. PCT/CA2021/050829, filed Jun. 17, 2021, which claims priority to U.S. Provisional Patent Application No. 63/043,176 filed Jun. 24, 2020 and titled "METHODS OF PROVIDING WELLBORES FOR ELECTROMAGNETIC HEATING OF UNDERGROUND HYDROCARBON FORMATIONS AND APPARATUS THEREOF"; the entire contents of each of which are hereby incorporated by reference for all purposes.

FIELD

The embodiments described herein relate to electromagnetic heating, and in particular to methods of providing wellbores to underground hydrocarbon formations and apparatus thereof.

BACKGROUND

The following is not an admission that anything discussed below is part of the prior art or part of the common general knowledge of a person skilled in the art.

Electromagnetic (EM) heating can be used for enhanced recovery of hydrocarbons from underground reservoirs. Similar to traditional steam-based technologies, the application of EM energy to heat hydrocarbon formations can reduce viscosity and mobilize bitumen and heavy oil within the hydrocarbon formation for production. Hydrocarbon formations can include heavy oil formations, oil sands, tar sands, carbonate formations, shale oil formations, and any other hydrocarbon bearing formations, or any other mineral.

EM heating of hydrocarbon formations can be achieved by using a load, such as an EM radiator, antenna, applicator, or lossy transmission line, positioned inside an underground reservoir to radiate, or couple, EM energy to the hydrocarbon formation. To carry EM power from a radio frequency (RF) generator to the antenna, transmission lines capable of delivering high EM power over long distances is required. Furthermore, such transmission lines must be capable of withstanding harsh environments (e.g., such as high pressure and temperature) usually found within underground oil wells.

Coaxial transmission lines can be routed in wellbores to transmit RF signals or power to the load in the underground hydrocarbon formation. However, the coaxial transmission line has high-energy density and electric fields with large magnitudes, which presents a risk of arcing. As well, routing of the coaxial transmission line within the wellbore can present additional arcing risk between the conductors of the coaxial transmission line and the inner surface of the wellbore. Furthermore, wellbore casings in the wellbores can provide a pathway for current to travel away from the load and to return to the surface. The return of current to the surface reduces the efficiency of the system and further increases the risk of arcing.

SUMMARY

This summary is intended to introduce the reader to the more detailed description that follows and not to limit or define any claimed or as yet unclaimed invention. One or more inventions may reside in any combination or subcombination of the elements or process steps disclosed in any part of this document including its claims and figures.

The various embodiments described herein generally relate to methods for providing wellbores for electromagnetic heating of underground hydrocarbon formations and apparatus thereof.

In accordance with an aspect of this disclosure, there is provided an apparatus for electromagnetic heating of an underground hydrocarbon formation positioned below a ground surface. The apparatus includes two or more wellbore casings positioned within two or more wellbores. The two or more wellbores extend from a proximal end at the ground surface to a distal end at the underground hydrocarbon formation. Each of the two or more wellbore casings have a proximal portion and a distal portion. The two or more wellbores are in proximity to one another at a junction. The apparatus also includes a first electrical connection between the proximal portions of the two or more wellbore casings for grounding the two or more wellbore casings; and a second electrical connection between the distal portions of the two or more wellbore casings to provide a short circuit that reduces current traveling on the two or more wellbore casings to the ground surface. The second electrical connection is located at the junction.

In at least one embodiment, at least part of a first wellbore of the two or more wellbores can define a first longitudinal axis extending from the proximal end to the distal end of the first wellbore. At least part of a second wellbore of the two or more wellbores can define a second longitudinal axis extending from the proximal end to the distal end of the second wellbore. The second longitudinal axis can traverse a projection of the first longitudinal axis at the junction.

In at least one embodiment, the first longitudinal axis and the second longitudinal axis can be substantially horizontal at the junction.

In at least one embodiment, the second electrical connection can include one or more electrical conductors.

In at least one embodiment, the one or more electrical conductors can include one or more electrically conducting fasteners. Each of the fasteners can securing a pair of wellbores of the two or more wellbore casings together.

In at least one embodiment, the second electrical connection can include outer surfaces of at least part of the distal portions of the two or more wellbore casings being in contact.

In at least one embodiment, the apparatus can include electrically conductive cement positioned within an interstitial space between the wellbores and the wellbore casings at the junction.

In at least one embodiment, the apparatus can include an additive to enhance conductivity of the electrically conductive cement.

In at least one embodiment, each of the two or more wellbore casings can terminate at a distal end. The distal ends of the wellbore casings can be proximal to the distal ends of the wellbores. The junction can be located substantially near at least one of the distal ends of the two or more wellbore casings.

In at least one embodiment, at least one of the two or more wellbores can be enlarged at the junction to join the two or more wellbores together.

In at least one embodiment, the two or more wellbores can include a lower wellbore and an upper wellbore. The at least one of the two or more wellbores being enlarged can include at least a lower portion of the upper wellbore being enlarged in a downward direction to join with an upper portion of the lower wellbore.

In at least one embodiment, the two or more wellbores being in proximity to one another at the junction can include at least a pair of wellbores of the two or more wellbores being laterally spaced less than one meter apart.

In at least one embodiment, the first electrical connection can include an electrical cable connected to an output ground of a wave generator.

In accordance with another aspect of this disclosure, there is a method for providing wellbores for electromagnetic heating of an underground hydrocarbon formation positioned below a ground surface. The method involves drilling a lower wellbore extending from a proximal end at the ground surface to a distal end at the underground hydrocarbon formation; installing a lower wellbore casing within the lower wellbore; drilling an upper wellbore extending from a proximal end at the ground surface to a distal end at the underground hydrocarbon formation and being in proximity to the lower wellbore at a junction; and installing an upper wellbore casing within the upper wellbore. Each of the lower wellbore casing and the upper wellbore casing have a proximal portion and a distal portion. The method further involves electrically connecting the distal portion of the upper wellbore casing to the distal portion of the lower wellbore casing; and electrically connecting and grounding the proximal portion of the upper wellbore casing to the proximal portion of the lower wellbore casing.

In at least one embodiment, the upper wellbore can be drilled after the lower wellbore is drilled.

In at least one embodiment, the method can further involve enlarging at least a lower portion of the upper wellbore in a downward direction at the junction to join with an upper portion of the lower wellbore together.

In at least one embodiment, enlarging the upper wellbore in a downward direction can involve reciprocating one of the upper wellbore casing and a drill string in a longitudinal direction.

In at least one embodiment, the method can further involve prior to reciprocating, attaching one or more outwardly protruding scrapers to the one of the upper wellbore casing and the drill string to increase a radial span and a cutting action radially downwards during reciprocation.

In at least one embodiment, enlarging the upper wellbore in a downward direction can further involve rotating one of the upper wellbore casing and the drill string.

In at least one embodiment, enlarging the upper wellbore can involve underreaming or hydraulic jetting the hydrocarbon formation.

In at least one embodiment, at least part of the lower wellbore can define a first longitudinal axis extending from the proximal end to the distal end of the lower wellbore; at least part of the upper wellbore can define a second longitudinal axis extending from the proximal end to the distal end of the upper wellbore; and the second longitudinal axis can traverse a projection of the first longitudinal axis at the junction.

In at least one embodiment, the first longitudinal axis and the second longitudinal axis can be substantially horizontal at the junction.

In at least one embodiment, the method can further involve using one or more electrical conductors to electrically connect the distal portion of the upper wellbore casing to the distal portion of the lower wellbore casing.

In at least one embodiment, the method can involve using a non-cement based fluid to displace cement in an interstitial space between the lower wellbore and the lower wellbore casing at the junction to facilitate installation of the one or more electrical conductors.

In at least one embodiment, the method can involve securing the upper wellbore casing to the lower wellbore casing with one or more electrically conducting fasteners.

In at least one embodiment, the method can involve installing the one or more electrically conducting fasteners using at least one of an explosive charge, hydraulic insertion, and drilling and tapping.

In at least one embodiment, the method can involve milling the electrical conductor within the lower wellbore casing to reduce protrusions of the electrical conductor from an inner surface of the lower wellbore casing.

In at least one embodiment, the method can involve using electrically conductive cement to fill an interstitial space between the lower wellbore and the lower wellbore casing at the junction and an interstitial space between the upper wellbore and the upper wellbore casing at the junction.

In at least one embodiment, the method can involve prior to using the electrically conductive cement, adding an additive to the electrically conductive cement to enhance conductivity.

In at least one embodiment, drilling the upper wellbore to be in proximity to the lower wellbore at the junction can involve drilling the upper wellbore to be laterally spaced less than one meter apart from the lower wellbore at the junction.

In at least one embodiment, electrically connecting and grounding the proximal portion of the upper wellbore casing to the proximal portion of the lower wellbore casing can involve using an electrical cable to connect the proximal portion of the upper wellbore casing and the proximal portion of the lower wellbore casing to an output ground of a wave generator.

It will be appreciated that the aspects and embodiments may be used in any combination or sub-combination. Further aspects and advantages of the embodiments described herein will appear from the following description taken together with the accompanying drawings.

BRIEF DESCRIPTION OF THE DRAWINGS

For a better understanding of the embodiments described herein and to show more clearly how they may be carried into effect, reference will now be made, by way of example only, to the accompanying drawings which show at least one exemplary embodiment, and in which.

Figure 1:
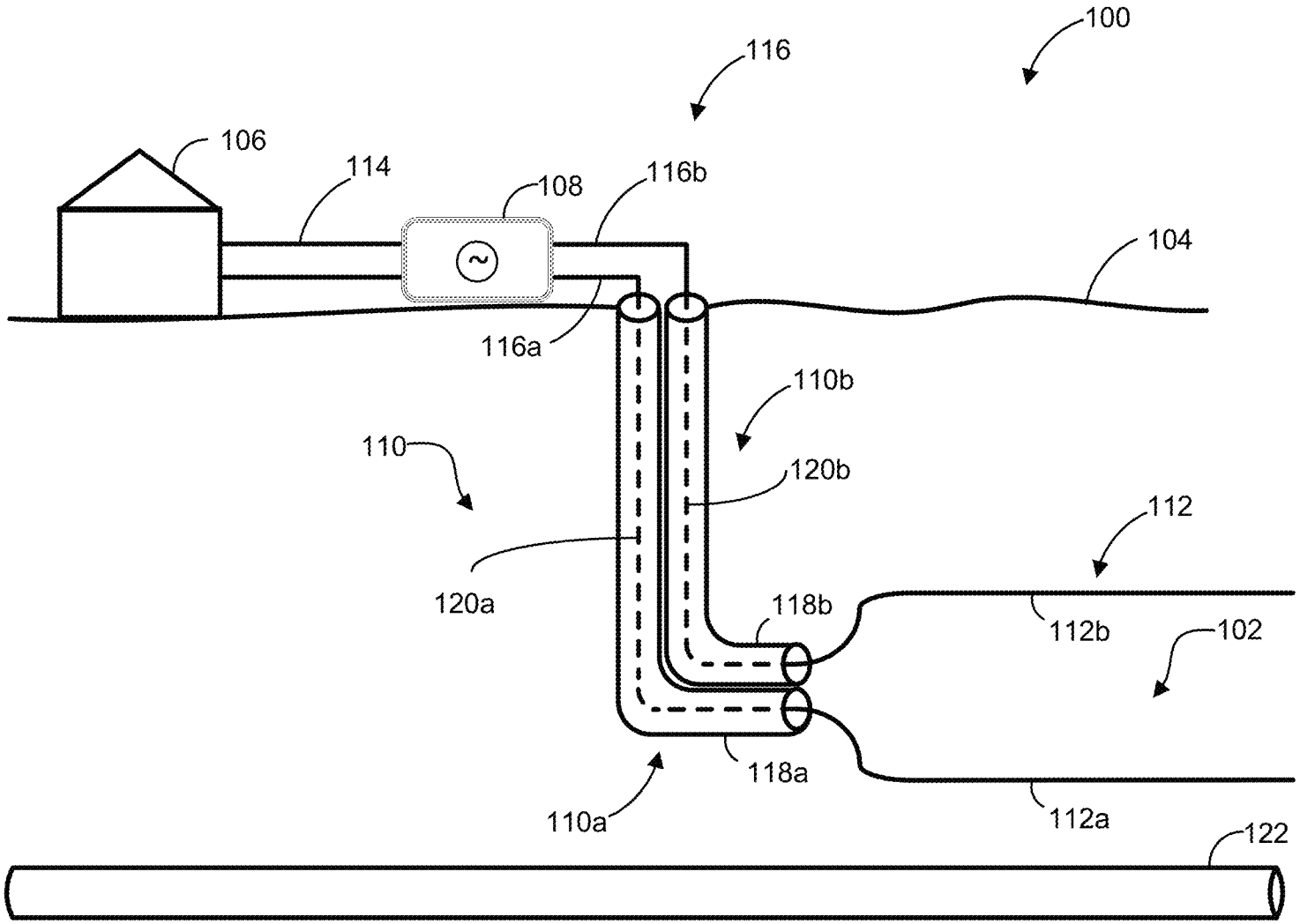
FIG. 1 is a schematic illustration of a profile view of an example system for electromagnetic heating of an underground hydrocarbon formation, in accordance with an embodiment.

The skilled person in the art will understand that the drawings, described below, are for illustration purposes only. The drawings are not intended to limit the scope of the applicants' teachings in any way. Also, it will be appreciated that for simplicity and clarity of illustration, elements shown in the figures have not necessarily been drawn to scale. For example, the dimensions of some of the elements may be exaggerated relative to other elements for clarity. Further, where considered appropriate, reference numerals may be repeated among the figures to indicate corresponding or analogous elements.

DESCRIPTION OF VARIOUS EMBODIMENTS

It will be appreciated that numerous specific details are set forth in order to provide a thorough understanding of the exemplary embodiments described herein. However, it will be understood by those of ordinary skill in the art that the embodiments described herein may be practiced without these specific details. In other instances, well-known methods, procedures and components have not been described in detail so as not to obscure the embodiments described herein. Furthermore, this description is not to be considered as limiting the scope of the embodiments described herein in any way, but rather as merely describing the implementation of the various embodiments described herein.

It should be noted that terms of degree such as "substantially", "about" and "approximately" when used herein mean a reasonable amount of deviation of the modified term such that the end result is not significantly changed. These terms of degree should be construed as including a deviation of the modified term if this deviation would not negate the meaning of the term it modifies.

In addition, as used herein, the wording "and/or" is intended to represent an inclusive-or. That is, "X and/or Y" is intended to mean X or Y or both, for example. As a further example, "X, Y, and/or Z" is intended to mean X or Y or Z or any combination thereof.

The terms "including," "comprising" and variations thereof mean "including but not limited to," unless expressly specified otherwise. A listing of items does not imply that any or all of the items are mutually exclusive, unless expressly specified otherwise. The terms "a," "an" and "the" mean "one or more," unless expressly specified otherwise.

As used herein and in the claims, two or more elements are said to be "coupled", "connected", "attached", or "fastened" where the parts are joined or operate together either directly or indirectly (i.e., through one or more intermediate parts), so long as a link occurs. As used herein and in the claims, two or more elements are said to be "directly coupled", "directly connected", "directly attached", or "directly fastened" where the element are connected in physical contact with each other. None of the terms "coupled", "connected", "attached", and "fastened" distinguish the manner in which two or more elements are joined together.

The terms "an embodiment," "embodiment," "embodiments," "the embodiment," "the embodiments," "one or more embodiments," "some embodiments," and "one embodiment" mean "one or more (but not all) embodiments of the present invention(s)," unless expressly specified otherwise.

A description of an embodiment with several components in communication with each other does not imply that all such components are required. On the contrary a variety of optional components are described to illustrate the wide variety of possible embodiments described herein.

Further, although process steps, method steps, algorithms or the like may be described (in the disclosure and/or in the claims) in a sequential order, such processes, methods and algorithms may be configured to work in alternate orders. In other words, any sequence or order of steps that may be described does not necessarily indicate a requirement that the steps be performed in that order. The steps of processes described herein may be performed in any order that is practical. Further, some steps may be performed simultaneously.

When a single device or article is described herein, it will be readily apparent that more than one device/article (whether or not they cooperate) may be used in place of a single device/article. Similarly, where more than one device or article is described herein (whether or not they cooperate), it will be readily apparent that a single device/article may be used in place of the more than one device or article.

Embodiments described herein may relate to and/or involve the use of time-harmonic signals. As a skilled reader will appreciate, references to phase shifts or phase differences between time-harmonic (e.g. a single frequency sinusoidal) signals can also be expressed as a time delay. For time harmonic signals, time delay and phase difference convey the same physical effect. For example, a 180° phase difference between two time-harmonic signals of the same frequency can also be referred to as a half-period delay. As a further example, a 90° phase difference can also be referred to as a quarter-period delay. References to time delay(s) may be used as a more general term for comparing periodic signals. For instance, if the periodic signals contain multiple frequencies (e.g. a series of rectangular or triangular pulses), then the time lag between two such signals having the same fundamental harmonic may be referred to as a time delay. For simplicity, in the description that follows, in the case of single frequency sinusoidal signals the term "phase shift" shall be used. In the case of multi-frequency periodic signals, the term "phase shift" will be understood to refer to the time delay equal to the corresponding time delay of the fundamental harmonic of the two signals.

As used herein, the term "radio frequency" may extend beyond the conventional meaning of radio frequency. As used herein, the term "radio frequency" generally includes frequencies at which the physical dimensions of system components are comparable to the wavelength of the EM wave. System components that are between approximately 1/16 of a wavelength to 10 wavelengths can be considered comparable to the wavelength. For example, a 1 kilometer (km) long underground system that uses EM energy to heat underground formations and operates at 50 kilohertz (kHz) will have physical dimensions that are comparable to the wavelength. If the underground formation has significant water content, (e.g., relative electrical permittivity being approximately 60 and conductivity being approximately 0.002 S/m), the EM wavelength at 50 kHz is 303 meters. The length of the 1 km long radiator is approximately 3.3 wavelengths. If the underground formation is dry (e.g., relative electrical permittivity being approximately 6 and conductivity being approximately 3E−7 S/m), the EM wavelength at 50 kHz is 2450 meters. The length of the radiator is then approximately 0.4 wavelengths. Therefore, in both wet and dry scenarios, the length of the radiator is considered comparable to the wavelength in the context of the disclosure herein. Accordingly, effects typically seen in conventional radio-frequency (RF) systems will be present and while a frequency of 50 kHz is not typically considered an RF frequency, in the disclosure herein such a system may be considered to be an RF system.

Referring to FIG. 1, shown therein is a schematic illustration of profile view of a system 100 for electromagnetic heating in accordance with an embodiment. The system 100 can be used for electromagnetic heating of an underground hydrocarbon formation 102. The system 100 includes an electrical power source 106, an electromagnetic (EM) wave generator 108 (also referred to as a signal generator), a waveguide portion 110, and a transmission line conductor portion 112.

As shown in FIG. 1, the electrical power source 106 and the electromagnetic wave generator 108 can be located at the surface 104. Alternately, one or both of the electrical power source 106 and the electromagnetic wave generator 108 can be located below ground.

The electrical power source 106 generates electrical power. The electrical power source 106 can be any appropriate source of electrical power, such as a stand-alone electric generator or an electrical grid. The electrical power source 106 may include transformers and/or rectifiers for providing electrical power with desired and/or required parameters. The electrical power can be one of alternating current (AC) or direct current (DC). Power cables 114 carry the electrical power from the electrical power source 106 to the EM wave generator 108.

The EM wave generator 108 generates EM power. It will be understood that EM power can be generated in various forms including high frequency alternating current, alternating voltage, current waves, or voltage waves. For example, the EM power can be a periodic high frequency signal having a fundamental frequency ($f_0$). The high frequency signal may have a sinusoidal waveform, square waveform, or any other appropriate signal shape. The high frequency signal can further include harmonics of the fundamental frequency. For example, the high frequency signal can include second harmonic $2f_0$, and third harmonic $3f_0$ of the fundamental frequency $f_0$. In some embodiments, the EM wave generator 108 can produce more than one frequency at a time. In some embodiments, the frequency and shape of the high frequency signal may change over time. The term "high frequency alternating current", as used herein, broadly refers to a periodic, high frequency EM power signal, which in some embodiments, can be a voltage signal.

As noted above, the EM wave generator 108 can be located above-ground. An apparatus with the EM wave generator 108 located above ground rather than underground can be easier to deploy.

Alternately, the EM wave generator can be located underground. When the EM wave generator 108 is located underground, transmission losses can be reduced because EM energy is not dissipated in areas that do not produce hydrocarbons (e.g. along the waveguide portion distance between the EM wave generator 108 and the transmission line conductor portion 112). High frequency connectors 116*a*, 116*b* carry high frequency alternating current from the EM wave generator 108 to the waveguide portion 110. As shown in FIG. 1, the high frequency connectors 116*a*, 116*b* can be collectively referred to as the high frequency connectors 116.

Each of the high frequency connectors 116*a*, 116*b* carry high frequency alternating current from the EM wave generator 108 to the inner conductors 120*a*, 120*b*. In some embodiments, the high frequency alternating current being transmitted to the first waveguide 110*a* via high frequency connector 116*a* is substantially identical to the high frequency alternating current being transmitted to the second waveguide 110*b* via high frequency connector 116*b*. The expression substantially identical is considered here to mean sharing the same waveform shape, frequency, amplitude, and being synchronized. In some embodiments, the high frequency alternating current being transmitted to the first waveguide 110*a* via high frequency connector 116*a* is a phase-shifted version of the high frequency alternating current being transmitted to the second waveguide 110*b* via high frequency connector 116*b*. The expression phase-shifted version is considered here to mean sharing the same waveform, shape, frequency, and amplitude but not being synchronized. In some embodiments, the phase-shift can be a 180° phase shift. In some embodiments, the phase-shift can be an arbitrary phase shift so as to produce an arbitrary phase difference.

The waveguide portion 110 can carry high frequency alternating current from the EM wave generator 108 to the transmission line conductors 112*a*, 112*b*. Each of the transmission line conductors 112*a*, 112*b* can be coupled to the EM wave generator 108 via individual waveguides 110*a*, 110*b*. As shown in FIG. 1, the waveguides 110*a*, 110*b* can be collectively referred to as the waveguide portion 110.

Each of the waveguides 110*a*, 110*b* can extend between a respective proximal end and a distal end. The proximal ends of each waveguide 110*a*, 110*b* can be connected to the EM wave generator 108. The distal ends of each waveguide 110*a*, 110*b* can be connected to the transmission line conductors 112*a*, 112*b* respectively.

As shown in the example of FIG. 1, each waveguide 110*a*, 110*b* can be provided by a coaxial transmission line having an outer conductor 118*a*, 118*b* and an inner conductor 120*a*, 120*b*, respectively. For example, each of the waveguides 110*a*, 110*b* can be provided using a wellbore casing coaxially surrounding an inner conductor 120*a*, 120*b* of the coaxial transmission line. The wellbore casing is typically a metal casing pipe and as such, can provide the outer conductor 118*a*, 118*b* of the coaxial transmission line. The inner conductor 120*a*, 120*b* can be a pipe, cable, wire, or conductor rods. When the inner conductor 120*a*, 120*b* is a coaxial cable, the outer conductor of the coaxial cable provides the outer conductor 118*a*, 118*b* of the coaxial transmission line itself. Optionally, the outer conductors 118*a*, 118*b* can be positioned within at least one additional casing pipe along at least part of the length of the waveguide portion 110.

The waveguide portion 110 is shown in FIG. 1 as being substantially vertical (i.e., perpendicular to the surface). In some embodiments, one or both of waveguides 110*a*, 110*b*, the outer conductors 118*a*, 118*b*, or sections thereof can be angled or curved with respect to the surface 104.

The transmission line conductor portion 112 can be coupled to the EM wave generator 108 via the waveguide portion 110. As shown in FIG. 1, the transmission line conductors 112*a*, 112*b* can be collectively referred to as the transmission line portion 112. In the example shown in FIG. 1, the transmission line portion 112 includes two transmission line conductors 112*a*, 112*b*. Optionally, the transmission line portion 112 can also include additional transmission line conductors.

Various configurations of the transmission line conductors 112*a*, 112*b* can be used. For example, both transmission line conductors 112*a*, 112*b* can be defined by a pipe. Alternately, only one or none of the transmission line conductors 112*a*, 112*b* can be defined by a pipe. Alternately or in addition, one or both of the transmission line conductors 112*a*, 112*b* can be provided using conductor rods, coiled tubing, or coaxial cables, or any other suitable conduit usable to propagate EM energy from EM wave generator 108.

In the example shown in FIG. 1, the transmission line conductors 112*a*, 112*b* are positioned in direct contact with the hydrocarbon formation 102. Alternately, the transmission line conductors 112 can be electrically isolated or partially electrically isolated from the hydrocarbon formation 102.

The transmission line conductors 112*a*, 112*b* have a proximal end (proximate the waveguide portion 110) and a distal end (spaced apart from the waveguide portion 110). The proximal end of each transmission line conductor 112*a*, 112*b* can be coupled to the EM wave generator 108. For example, the proximal end of each transmission line conductor 112*a*, 112*b* can be coupled to the EM wave generator 108 via the corresponding waveguides 110*a*, 110*b* as shown in FIG. 1.

The transmission line conductors 112*a*, 112*b* can be excited by the high frequency alternating current generated by the EM wave generator 108. When excited, the transmission line conductors 112*a*, 112*b* can form an open transmission line that includes transmission line conductors 112*a*, 112*b* and medium 102. The transmission line can propagate EM energy that is contained within a cross-section of a radius of several meters to several tens of meters depending on the frequency of excitation. The open transmission line can propagate an EM wave from the proximal end of the transmission line conductors 112*a*, 112*b* to the distal end of the transmission line conductors 112*a*, 112*b*. The open transmission line can also propagate a reflected EM wave in the opposite direction from the distal end to the proximal end upon reflection of the EM wave at the distal end.

Optionally, the EM wave may establish a standing wave along the transmission line 112. Alternately, the propagating electromagnetic wave may form a standing electromagnetic wave or an exponentially decaying wave depending on the loss properties of the medium and the frequency of generator excitation.

An open transmission line can carry and dissipate energy within the dielectric medium. In the example of system 100, the hydrocarbon formation 102 between the transmission line conductors 112*a*, 112*b* can act as a dielectric medium for the open transmission line formed by the transmission line conductors 112*a*, 112*b*. The open transmission line can carry and dissipate energy within this dielectric medium, that is, the hydrocarbon formation 102.

The open transmission line carrying EM energy within the hydrocarbon formation 102 can be referred to as a "dynamic transmission line" as medium properties change over time. The transmission line conductors 112 can be configured to propagate an EM wave in both directions. This can allow the dynamic transmission line to carry EM energy within long well bores (as used herein, well bores spanning a length of 500 meters (m) to 1500 meters (m) or more can be considered long well bores).

Producer well 122 is typically located at or near the bottom of the underground reservoir. The producer well 122 can be configured to receive heated oil released from the hydrocarbon formation 102 by the EM heating process. The heated oil can drain mainly by gravity to the producer well 122.

The producer well 122 can define a producer well longitudinal axis. The transmission line conductors 112*a*, 112*b* can also define respective transmission line longitudinal axes. The producer well longitudinal axis and the transmission line longitudinal axes can be parallel or even coincident. Thus, the transmission line conductors 112*a*, 112*b* may extend in a direction generally parallel to the producer well 122 (e.g. along an axes coincident with a vertical projection of the producer well 122). As shown in the example of FIG. 1, producer well 122 is substantially horizontal (i.e., parallel to the surface 104). The transmission line conductors 112*a*, 112*b* may also extend in a substantially horizontal direction. In some embodiments, the transmission line conductors 112*a*, 112*b* can be a combination of substantially horizontal, substantially vertical, and angled portions with respect to the surface 104.

The producer well 122 can be located at the same depth or at a greater depth than (i.e. below) at least one of the transmission line conductors 112*a*, 112*b* of the open transmission line 112. Alternately, the producer well 122 can be located above the transmission line conductors 112*a*, 112*b* of the open transmission line 112.

The producer well 122 can be positioned laterally in between the transmission line conductors 112*a*, 112*b*. For example, the producer well 122 can be positioned centered between the transmission line conductors 112*a*, 112*b*. Alternately, the producer well 122 can be positioned with any appropriate offset from the lateral center between the transmission line conductors 112*a*, 112*b*. In some applications, it can be advantageous to position the producer well 122 closer to a first transmission line conductors than a second transmission line conductor. This may allow the region closer to the first transmission line conductor to be heated faster and contribute to early onset of oil production.

Various well holes are drilled and completed to provide the producer well 122 and transmission line conductors 112*a*, 212*b*. In some embodiments, a wellbore (i.e., well hole) for the producer well 122 can be drilled and completed similar to a producer well of a conventional steam assisted gravity drain system.

As will be appreciated, the system 100 shown in FIG. 1 is provided for illustration purposes only and other suitable configurations of a system for electromagnetic heating of hydrocarbon formations are possible. Although only two waveguides 110*a*, 110*b*, two transmission line conductors 112*a*, 112*b*, and one producer well 122 is shown in FIG. 1, the system 100 can include more waveguides 110*a*, 110*b*, more transmission line conductors 112*a*, 112*b*, and/or more producer wells 122.

Figure 2:
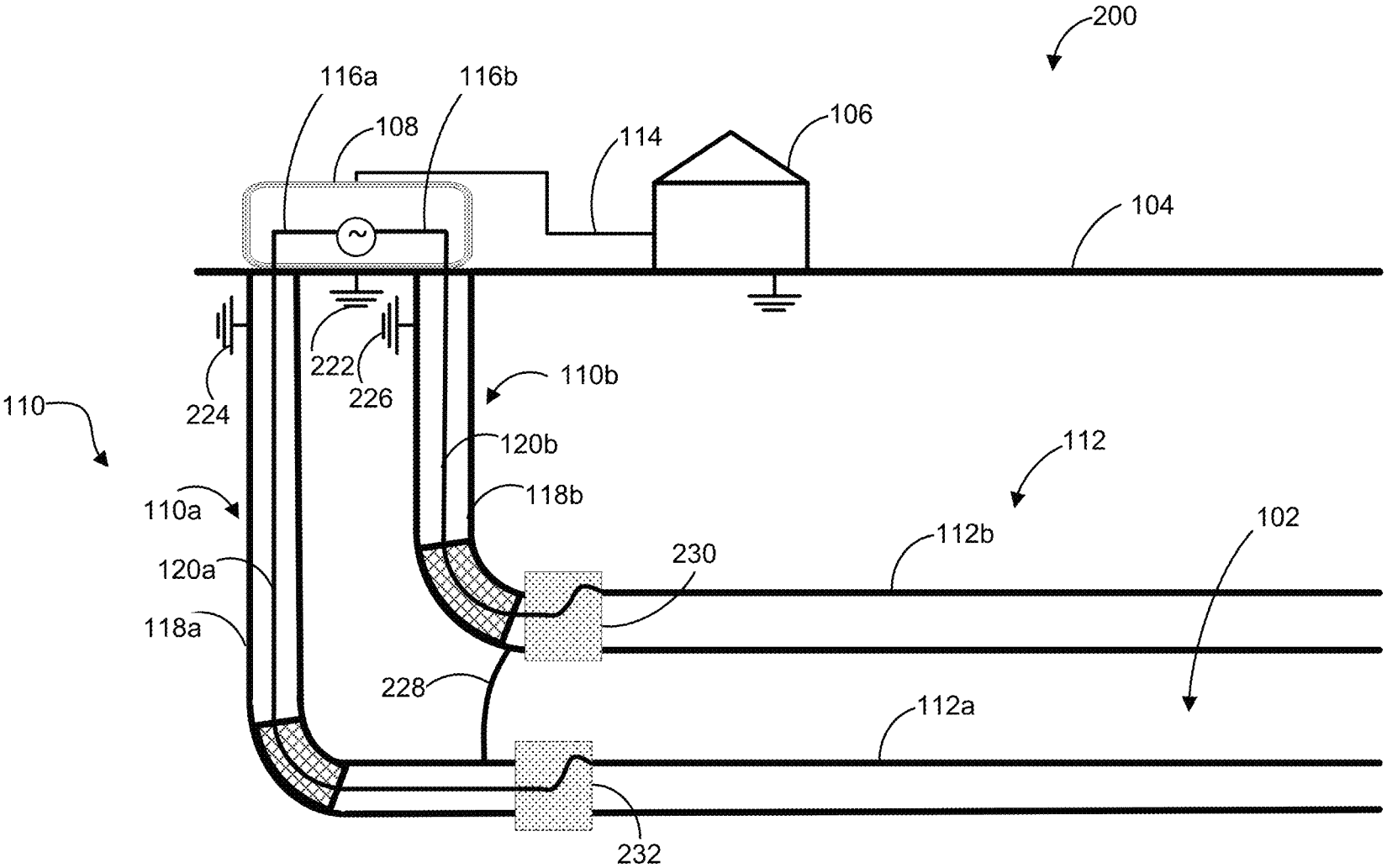
FIG. 2 is a schematic illustration of a profile view of another example system for electromagnetic heating of an underground hydrocarbon formation, in accordance with an embodiment.

Referring to FIG. 2, shown therein is a schematic illustration of a profile view of another example system 200 for electromagnetic heating of an underground hydrocarbon formation 102, in accordance with an embodiment.

Similar to system 100, system 200 includes an electrical power source 106, an EM wave generator 108, a waveguide portion 110, and a transmission line conductor portion 112. Power cables 114 can carry the electrical power from the electrical power source 106 to the EM wave generator 108. The EM wave generator 108 is electrically grounded 222. High frequency connectors 116*a*, 116*b* can carry high frequency alternating current from the EM wave generator 108 to the waveguides 110*a*, 110*b*, respectively. For example, high frequency connectors 116*a*, 116*b* can include an electrical connector and latch apparatus for connecting to the EM wave generator 108.

As shown in FIG. 2, the waveguides 110*a*, 110*b* can be routed in separate wellbores. That is, waveguide 110*a* can be routed in a first wellbore and waveguide 110*b* can be routed in a second wellbore. Each waveguide 110*a*, 110*b* can be a coaxial transmission line having an outer conductor 118*a*, 118*b* and an inner conductor 120*a*, 120*b*. The outer conductors 118*a*, 118*b* can be provided by the wellbore casings.

The wellbore casings can form non-radiating coaxial transmission lines and prevent direct contact between the inner conductors 120*a*, 120*b* and the hydrocarbon formation along the vertical portion of the waveguide portion 110. That is, the inner conductors 120*a*, 120*b* can be routed in the wellbore casings.

However, with the inner conductors 120*a*, 120*b* routed in the wellbore casings, the outer surface of the wellbore casing and the outer surface of the inner conductor may provide a pathway, along which high frequency alternating current can travel away from the transmission line conductors 112 and return to the surface 104. The return of high frequency alternating current results in inefficiencies and presents safety risks.

Figure 3B:
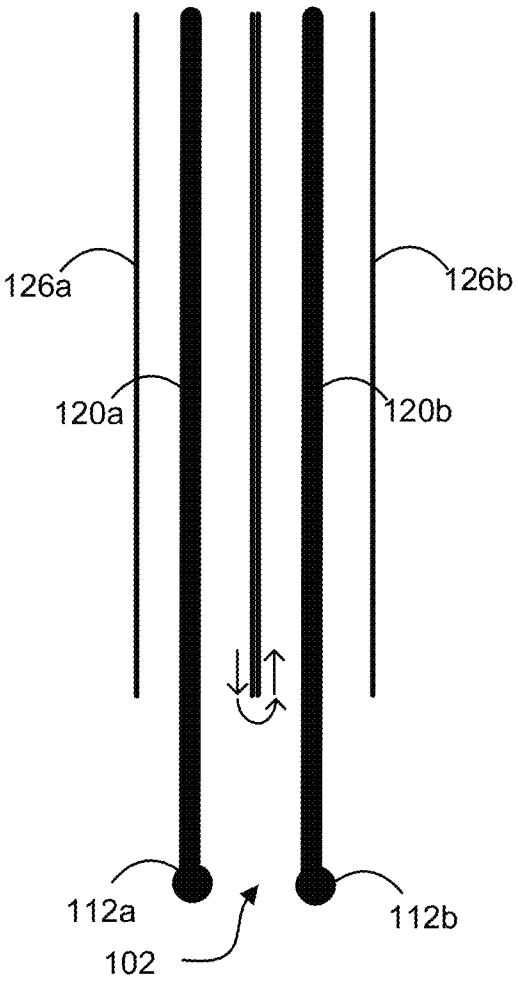
FIG. 3B is a schematic illustration of a cross-sectional view of a portion of the system of FIG. 2, in accordance with another embodiment.
Figure 3A:
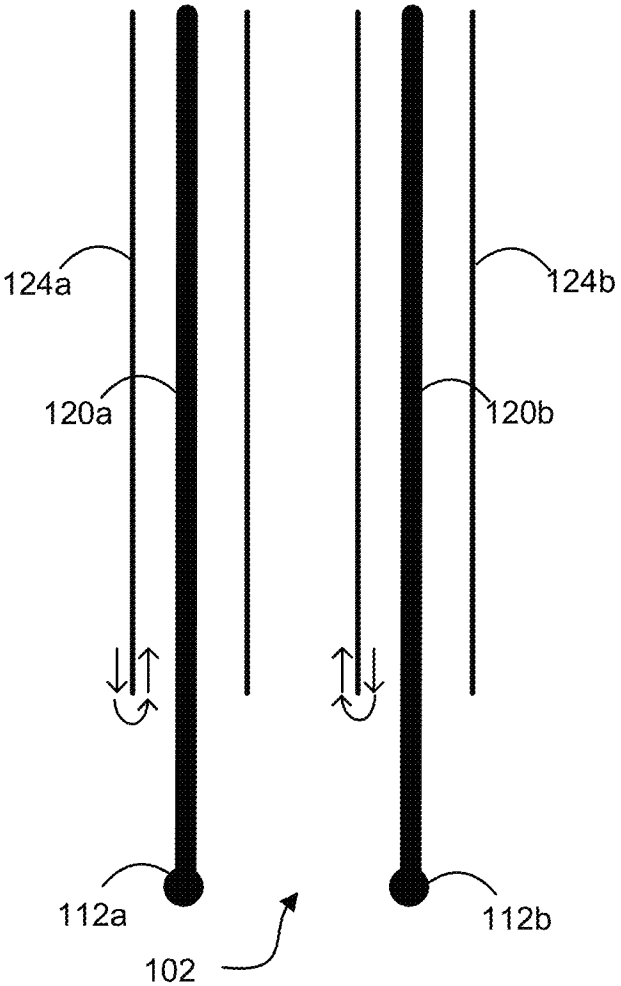
FIG. 3A is a schematic illustration of a cross-sectional view of a portion of the system of FIG. 2, in accordance with an embodiment.

Referring now to FIG. 3A, shown therein is a schematic illustration of a cross-sectional view of a portion of the system of FIG. 2, in accordance with an embodiment. In a first example, current from the EM wave generator 108 can travel down the inner conductor 120*a* to the transmission line conductor 112*a*. EM energy can propagate to the medium 102 and return from transmission line conductor 112*b* and up the inner conductor 120*b*. In some embodiments, a coaxial cable routed within the wellbore casing can provide the coaxial transmission line. That is, the inner conductor of the coaxial cable can serve as the inner conductor 120*a*, 120*b* and the outer conductor of the coaxial cable (not shown in FIG. 3A) can serve as the outer conductor 118*a*, 118*b*. In other embodiments, the wellbore casing can serve as the outer conductor 118*a*, 118*b*.

In FIG. 3A, the wellbores are positioned such that the wellbore casings 124*a*, 124*b* are not in contact with one another. When the wellbore casings 124*a*, 124*b* are not in contact with one another, current on the inner surfaces of the wellbore casings 124*a*, 124*b* can, at the distal end of the wellbore casing 124*a*, 124*b* flow over to the outer surface of the wellbore casing 124*a*, 124*b* and the outer surface of the outer conductor 118*a*, 118*b*.

High frequency alternating current travelling on the outer surface of the wellbore casing 124*a*, 124*b* and the outer surface of the outer conductor 118*a*, 118*b* may travel in a direction that is different from the direction of the EM propagating along the transmission line conductors 112. That is, high frequency alternating current travelling on the outer surface of the wellbore casing 124*a*, 124*b* and the outer surface of the outer conductor 118*a*, 118*b* may travel in a direction away from the transmission line conductors 112 and return to the surface 104, or above ground.

Referring to FIG. 3B, shown therein is a schematic illustration of a cross-sectional view of a portion of the system of FIG. 2, in accordance with another embodiment. In FIG. 3B, the wellbores are positioned such that the wellbore casings 126*a*, 126*b* are in contact with one another, providing a short circuit between wellbore casings 126*a*, 126*b*. When a short circuit is provided between wellbore casings 126*a*, 126*b*, current on the inner surfaces of the wellbore casings 126*a*, 126*b* can flow to one another. As a result, the short circuit can block a substantial portion of current from travelling along the outer surface of the wellbore casings 126*a*, 126*b* and the outer surface of the outer conductor 118*a*, 118*b*. This embodiment can mitigate current travelling on the outer surface of the wellbore casings 126*a*, 126*b* and the outer surface of the outer conductor 118*a*, 118*b* and returning to the surface 104.

Returning now to FIG. 2, the outer conductors 118*a*, 118*b* can be electrically grounded 224, 226 to a common ground to provide a short circuit to block a substantial portion of high frequency alternating current from travelling along the outer surfaces of the waveguides 110, and in particular, the outer conductors 118*a*, 118*b*. In some embodiments, the outer conductors 118*a*, 118*b* can be electrically grounded to a common ground as the EM wave generator 108. For example, a heavy electrical cable can be used to connect the outer conductors 118*a*, 118*b* to the output ground 222 of the EM wave generator 108. In addition, an electrical short 228 can be provided between the outer conductors 118*a*, 118*b* to further provide a short circuit that blocks or limits a substantial portion of high frequency current from flowing back to the surface 104.

The inner conductors 120*a*, 120*b* are energized by high frequency connectors 116*a*, 116*b*. The inner conductors 120*a*, 120*b* can carry high frequency alternating current from EM wave generator 108 to the transmission line conductors 112*a*, 112*b*, respectively. As shown in FIG. 2, electrically insulating material 230, 232 can be provided at the connections between the inner conductors 120*a*, 120*b* and the transmission line conductors 112*a*, 112*b* to electrically isolate the transmission line portion 112 from the waveguide portion 110. Electrically insulating material 230, 232 can also be provided to plug the opening of the wellbore casing.

As will be appreciated, the system 200 shown in FIG. 2 is provided for illustration purposes only and other suitable configurations of a system for electromagnetic heating of hydrocarbon formations are possible. Although only two wellbores, two waveguides 110*a*, 110*b*, and two transmission line conductors 112*a*, 112*b* are shown in FIG. 2, the system 200 can include more waveguides 110*a*, 110*b* and/or more transmission line conductors 112*a*, 112*b*. Furthermore, some elements are not shown in FIG. 2 for simplicity. For example, system 200 also includes at least one producer well 122 and one or more additional casings for the wellbores.

As well, at least part of a length of the outer conductors 118*a*, 118*b* of the waveguide portion 110 can be coaxially surrounded by a separation medium for preserving the structural integrity of the wellbore. The separation medium can be formed of cement, for example.

Figure 4:
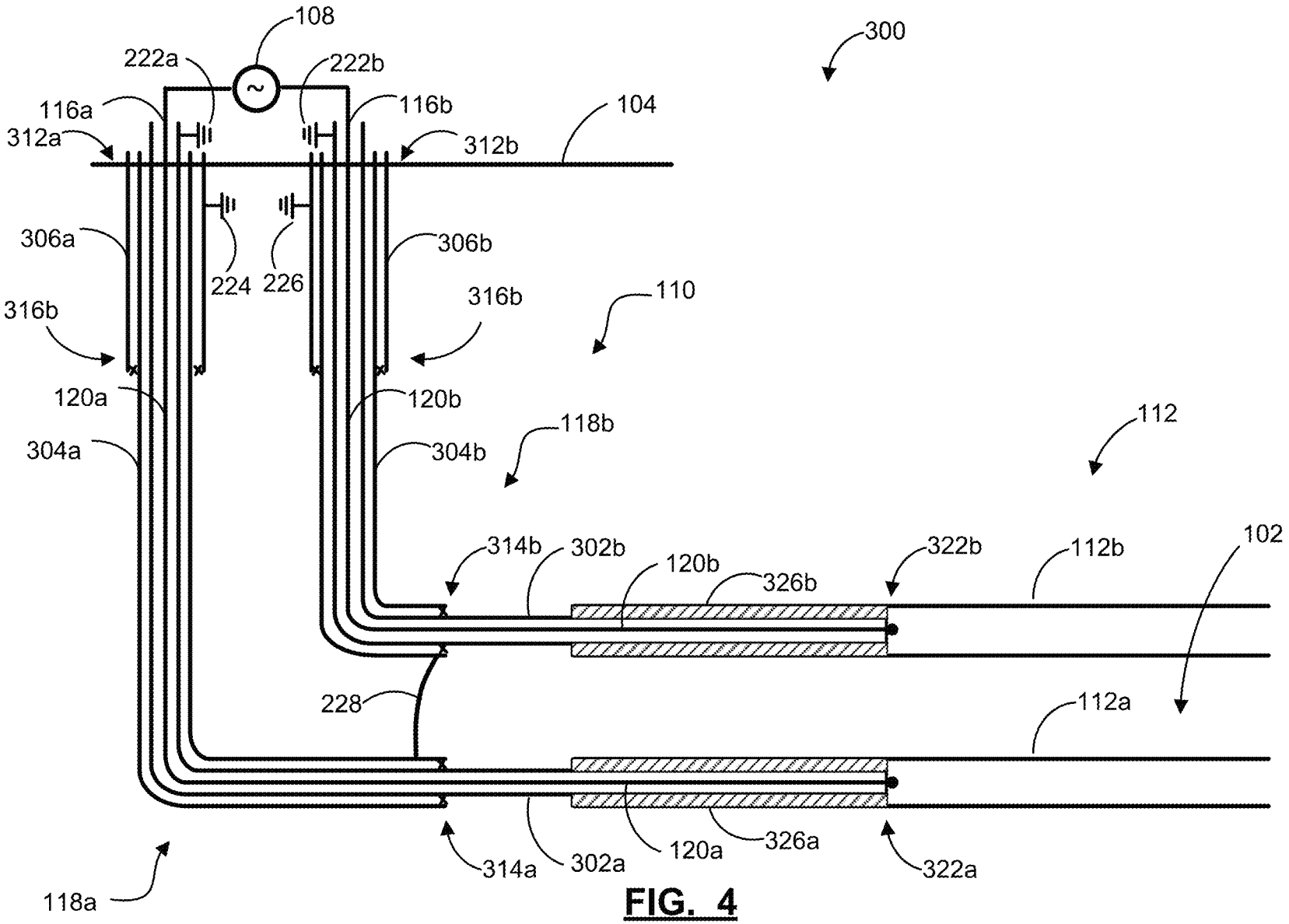
FIG. 4 is a schematic illustration of a profile view of another example system for electromagnetic heating of an underground hydrocarbon formation, in accordance with an embodiment.

Referring now to FIG. 4, shown therein is a schematic illustration of a profile view of another example system 300 for electromagnetic heating of an underground hydrocarbon formation 102, in accordance with an embodiment. In FIG. 4, the wellbore casings are shown in greater detail. It should be noted that the systems 100, 200 are simplified and can include similar features as that of system 300. Furthermore, some elements are not shown in FIG. 3 for simplicity. For example, system 300 also includes an electrical power source 106 and at least one producer well 122.

Similar to system 200, system 300 includes an EM wave generator 108, a waveguide portion 110, and a transmission line conductor portion 112. Similar to electrically insulating material 230, 232 of system 200, isolation sleeves 326*a*, 326*b* can be provided at the connection 322*a*, 322*b* between the inner conductors 120*a*, 120*b* and the transmission line conductors 112*a*, 112*b* to electrically isolate the waveguide portion 110, or more specifically, the outer conductors 118*a*, 118*b*, from the transmission line portion 112.

Each wellbore can define a longitudinal axis extending from the proximal end 312*a*, 312*b* at the surface 104 to a distal end at the underground hydrocarbon formation 102. As shown in FIG. 4, the longitudinal axes can include a substantially vertical portion and a substantially horizontal portion with respect to the surface 104. Generally, the waveguide portion 110 is provided along the substantially vertical portion of the wellbore longitudinal axis and the transmission line portion 112 is provided along the substantially horizontal portion of the wellbore longitudinal axis.

Each wellbore can include a plurality of coaxial wellbore casings such as, but not limited to, a production casing 302*a*, 302*b*, an intermediate casing 304*a*, 304*b*, and a surface casing 306*a*, 306*b*. The production casings 302*a*, 302*b* can be metal casing pipes and can serve as outer conductors 118*a*, 118*b* of the waveguide portion 110. The intermediate casings 304*a*, 304*b* can extend from the proximal end 312*a*, 312*b* at the surface 104 to a distal end 314*a*, 314*b* that terminates at a location that is proximal to the distal end of the wellbore. Each production casing 302*a*, 302*b* can be connected to the respective intermediate casing 304*a*, 304*b*. The surface casings 306*a*, 306*b* can extend from the proximal end 312*a*, 312*b* at the surface 104 to a distal end 316*a*, 316*b* that terminates at a location that is proximal to the distal end of the intermediate casing 304*a*, 304*b*.

As described in reference to system 200, electrical connections can be provided to limit a substantial portion of high frequency current from flowing back to the surface 104. At the proximal portion of the waveguide 110, the outer conductors 118*a*, 118*b* can be electrically grounded to a common ground to provide a short circuit. For example, the production casings 302*a*, 302*b* can be electrically grounded 222*a*, 222*b* to a common ground as the EM wave generator 108. In addition, the surface casings 306*a*, 306*b* can be electrically grounded 224, 226. At the distal portion of the waveguide 110, an electrical short 228 can be provided to connect the outer conductors 118*a*, 118*b*. For example, an electrical short 228 can connect the intermediate casings 304*a*, 304*b* together while each production casing 302*a*, 302*b* can be connected to the respective intermediate casing 304*a*, 304*b*. In at least one embodiment, one or more electrical conductors can be provided between the intermediate casings 304*a*, 304*b* to provide the electrical short 228.

As described above in respect of FIGS. 3A and 3B, current on the inner surface of the outer conductor 118*a*, 118*b* can flow to the outer surface of the outer conductor 118*a*, 118*b*. Current on the outer surface of the outer conductor 118*a*, 118*b* results in energy losses. With the production casing 302*a*, 302*b* connected to the respective intermediate casing 304*a*, 304*b*, current on the inner surface of the production casing 302*a*, 302*b* can flow to the outer surface of the intermediate casing 304*a*, 304*b*. To reduce such losses, the electrical short 228 can be positioned at, or as close to the distal ends of the waveguides 110*a*, 110*b* as feasible. For example, the electrical short 228 can be positioned at at least one the distal ends 314*a*, 314*b* of the intermediate casings 304*a*, 304*b*. In at least one embodiment, the electrical short 228 can be positioned along the substantially horizontal portion of at least one of the longitudinal axes of the wellbores. In at least one embodiment, the electrical short 228 can be positioned along the transition between the substantially vertical portion and the substantially horizontal portion of at least one of the longitudinal axes of the wellbores.

In addition, an impedance, or more specifically an inductance, can occur along the length of the electrical short 228 and result in a voltage drop over the electrical short 228 and a voltage difference between the outer conductors 118*a*, 118*b*. To reduce the voltage difference between outer conductors 118*a*, 118*b*, it can be desirable to position the wellbores in proximity to one another so that the wellbore casings can be in direct mechanical contact with one another, or that the length of the electrical short 228 is reduced. By reducing the length of the electrical short 228, the impedance of the electrical short 228 is reduced, thereby reducing the voltage drop over the electrical short 228 and the voltage difference between the outer conductors 118*a*, 118*b*. For example, in at least one embodiment, the length of the electrical short 228 is less than one meter. That is, the electrical short 228 can be provided at a junction in which the wellbores are laterally spaced less than one meter apart.

Figure 5A:
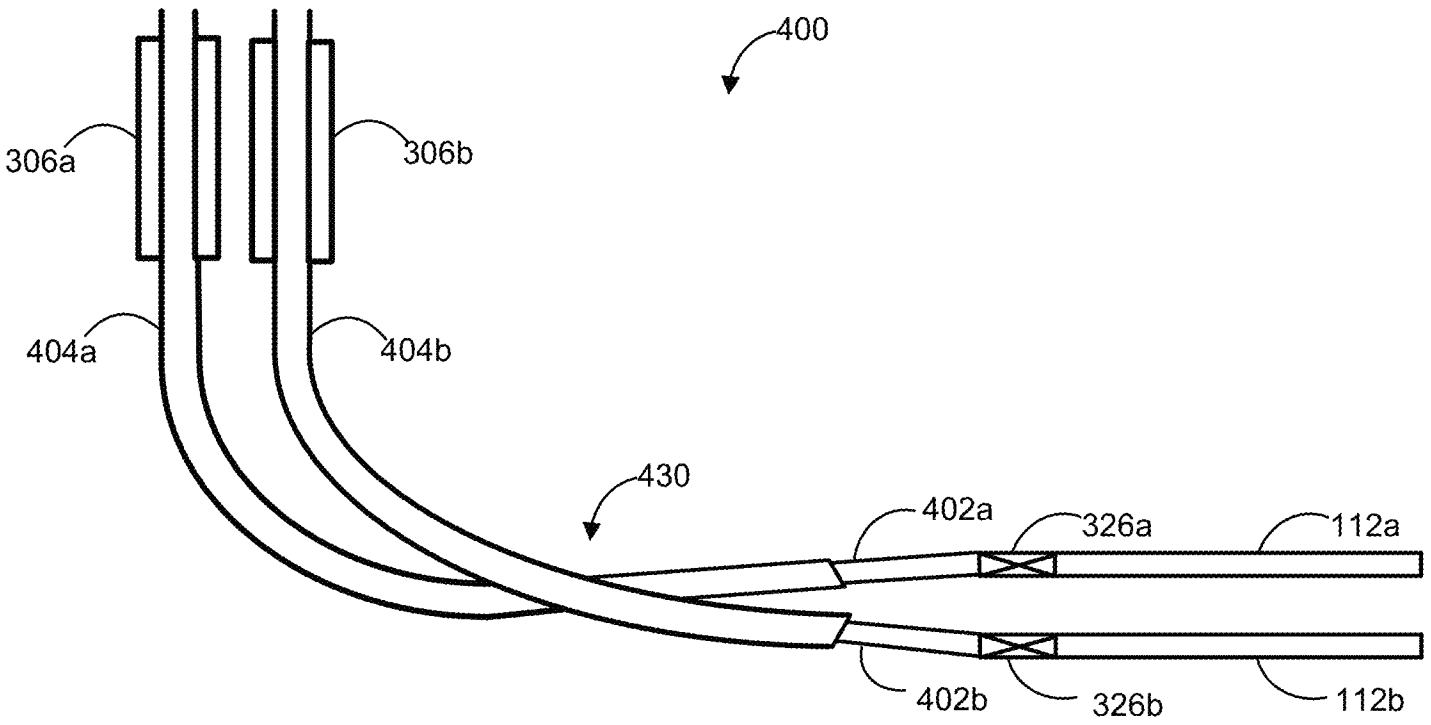
FIG. 5A is a schematic illustration of a profile view of another example system for electromagnetic heating of an underground hydrocarbon formation, in accordance with an embodiment.

Referring now to FIG. 5A, shown therein is are schematic illustration of a profile view of another example system 400 for electromagnetic heating of an underground hydrocarbon formation 102, in accordance with an embodiment. It should be noted that system 400 is simplified and can include similar features as that of systems 100, 200, 300. For example, system 400 also includes inner conductors 120*a*, 120*b*, at least one producer well 122, an EM wave generator 108, and an electrical power source 106.

Similar to system 300, system 400 includes transmission line conductors 112*a*, 112*b* that can be coupled to the waveguide portion 110, and more specifically, the inner conductors 120*a*, 120*b*. In addition, isolation sleeves 326*a*, 326*b* can be provided at the connection to electrically isolate the transmission line conductors 112*a*, 112*b* from the production casings 402*a*, 402*b*, which serve as the outer conductors 118*a*, 118*b*. The production casings 402*a*, 402*b* are positioned within and extend distally further than the intermediate casings 404*a*, 404*b*, respectively. Surface casings 306*a*, 306*b* surround at least part of the proximal portions of the intermediate casings 404*a*, 404*b*.

System 400 can include a junction 430 at which the wellbores crossover one another. More specifically, at junction 430 with intermediate casing 404*a* being at a greater depth from the surface 104 than intermediate casing 404*b*, the longitudinal axis of intermediate casing 404*b* can traverse a projection of the longitudinal axis of intermediate casing 404*a*. Alternately, if intermediate casing 404*b* is at a greater depth from the surface 104 than intermediate casing 404*a*, the longitudinal axis of intermediate casing 404*a* can traverse a projection of the longitudinal axis of intermediate casing 404*b*.

The crossover brings the wellbores in closer proximity to one another. That is, the crossover can provide a junction 430 at which the lateral spacing between wellbores is reduced. As described above, it can be desirable to provide the electrical short 228 along the substantially horizontal portion of the longitudinal axis of at least one of the wellbores. As shown in FIG. 5A, junction 430 can be provided along the substantially horizontal portion of the longitudinal axis of the wellbores. In some embodiments, it can be preferable to provide the crossover at the intermediate casing 304*a*, 304*b* to avoid damage to the inner conductor 120*a*, 120*b* of the waveguide 110*a*, 110*b* during installation of the crossover.

Figure 5C:
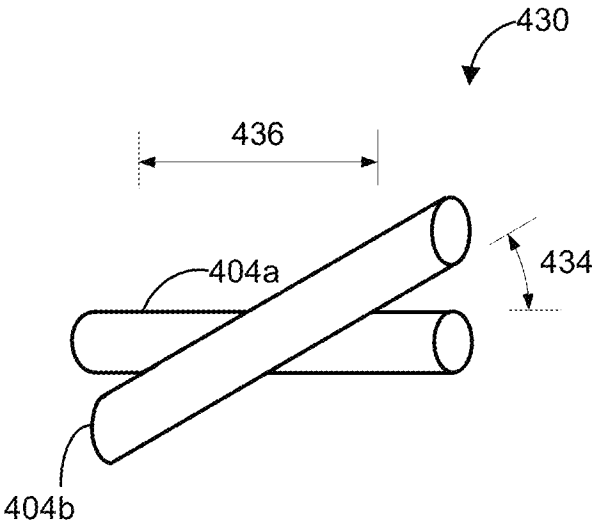
FIG. 5C is a schematic illustration of another perspective view of the junction of the system in FIG. 5A, in accordance with an embodiment.
Figure 5B:
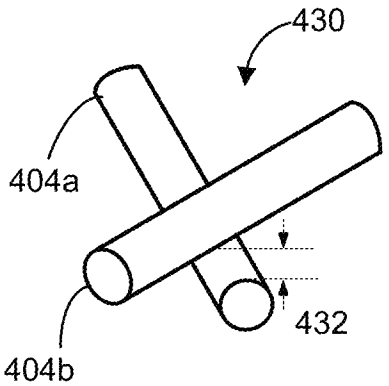
FIG. 5B is a schematic illustration of a perspective view of a junction of the system in FIG. 5A, in accordance with an embodiment.

Referring now to FIG. 5B, shown therein is a schematic illustration of a perspective view of junction 430 of system 400 of FIG. 5A, in accordance with an embodiment. The wellbores 404*a*, 404*b* can be drilled to have a crossover at junction 430 that brings the wellbores 404*a*, 404*b* in proximity to one another. As shown in FIG. 5B, the wellbores 404*a*, 404*b* may not initially join or intersect at junction 430. That is, the lower wellbore 404*a* and the upper wellbore 404*b* can be laterally spaced apart at junction 430. In at least one embodiment, the wellbores 404*a*, 404*b* can be drilled so that the upper wellbore 404*b* can be less than one meter apart from the lower wellbore 404*b*. More specifically, the shortest distance between outer surfaces of the lower wellbore 404*b* and the upper wellbore 404*a* can be less than 10 meters, and preferably less than 1 meter. In at least one embodiment, the shortest distance 432 between the outer surfaces of the wellbores 404*a*, 404*b* can be approximately 0.15 meters (i.e., 6 inches).

Referring now to FIG. 5C, shown therein is a schematic illustration of another perspective view of junction 430 of FIG. 5A. The crossover can be drilled using horizontal drilling techniques. In particular, horizontal drilling techniques can be used to drill the upper wellbore having a longitudinal axis at an angle 434 from the longitudinal axis of the lower wellbore. Current horizontal drilling techniques can provide an angle 434 from approximately 5° to approximately 90°. In at least one embodiment, angle 434 can be approximately 5°.

In at least one embodiment, a length 436 of junction 430 can relate to a smallest distance in which any portion of the upper wellbore 404*b* traverses the projection of the lower wellbore 404*a*. Generally, the length 436 of junction 430 can depend on the angle 434 and the diameter of the wellbore casings 404*a*, 404*b*. A longer junction 430 can provide more space for electrically connecting wellbore casings 404*a*, 404*b*. Furthermore, multiple electrical connections between wellbore casings 404*a*, 404*b* can be provided when space permits. Multiple electrical connections increases electrical conductivity between wellbore casings 404*a*, 404*b*, thereby increasing robustness and reliability. For example, the length 436 of the junction can be within the range of approximately 2 meters to approximately 20 meters. In at least one embodiment, the length 436 of junction 430 can be within the range of approximately 5 meters to approximately 10 meters.

In at least one embodiment, at least one of the wellbores can be enlarged at junction 430 to join the wellbores together so that the wellbore casings 404*a*, 404*b* can be placed in direct mechanical contact. For example, the lower portion of the upper wellbore can be enlarged in a downward direction at junction 430 by the distance 432 to join together with the upper portion of the lower wellbore. Alternatively, the upper portion of the lower wellbore can be enlarged in an upward direction at junction 430 by the distance 432 to join together with the lower portion of the upper wellbore. In at least one embodiment, both the lower portion of the upper wellbore and the upper portion of the lower wellbore can be enlarged. Together, the enlargement of the upper wellbore and lower wellbore can amount to a distance 432 in the vertical direction. With the upper wellbore and lower wellbore joined together, the wellbore casings 404*a*, 404*b* can be brought together in direct mechanical contact.

Figure 6A:
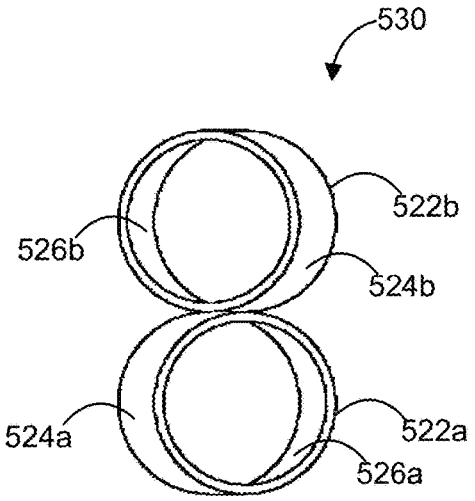
FIG. 6A is a schematic illustration of a cross-sectional view of a portion of wellbore casings, in accordance with an embodiment.

Referring now to FIG. 6A, shown therein is a schematic illustration of a cross-sectional view of another example junction 530, in accordance with an embodiment. As can be seen in FIG. 6A, each wellbore casing 522*a*, 522*b* has outer surfaces 524*a*, 524*b* and inner surfaces 526*a*, 526*b*. With junction 530, the wellbore casings 522*a* and 522*b* are in direct mechanical contact with one another. That is, at least a portion of the outer surfaces 524*b* of the lower portion of the upper wellbore casing 522*b* is in contact with at least a portion of the outer surfaces 524*a* of the upper portion of the lower wellbore casing 522*a*. Since the wellbore casings are in contact with one another, the outer conductors are short circuited and inductance between the wellbore casings 522*a* and 522*b* is reduced.

Figure 6B:
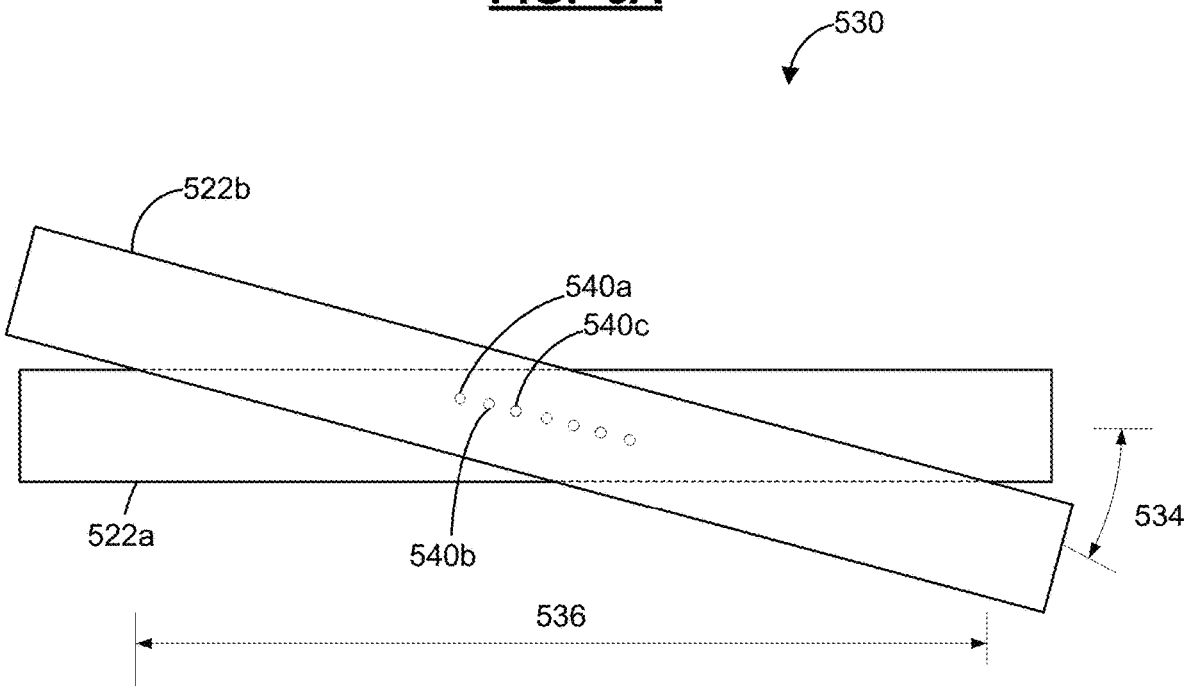
FIG. 6B is a schematic illustration of a top view of a portion of the wellbore casings of FIG. 6A, in accordance with an embodiment.

Referring now to FIG. 6B, shown therein is a schematic illustration of a top view of the example junction 530 of FIG. 6A with one or more electrical conductors. As shown in FIG. 6B, one or more electrical conductors 540*a*, 540*b*, 540*c* can be provided between the wellbore casings 522*a*, 522*b*. Similar to junction 430, the longitudinal axis of the upper wellbore casing 522*b* can be offset by an angle 534 from the longitudinal axis of the lower wellbore casing 522*a*. As well, the length of junction 536 can be a smallest distance in which any portion of the upper wellbore casing 522*b* traverses the projection of the lower wellbore casing 522*a*.

Although nine electrical conductors 540*a*, 540*b*, 540*c* are shown in FIG. 6B, junction 530 can include fewer or more electrical conductors 540*a*, 540*b*, 540*c*. As well, although the nine electrical conductors 540*a*, 540*b*, 540*c* are laid out in a line, the electrical conductors can be arranged in any appropriate layout.

Figure 6C:
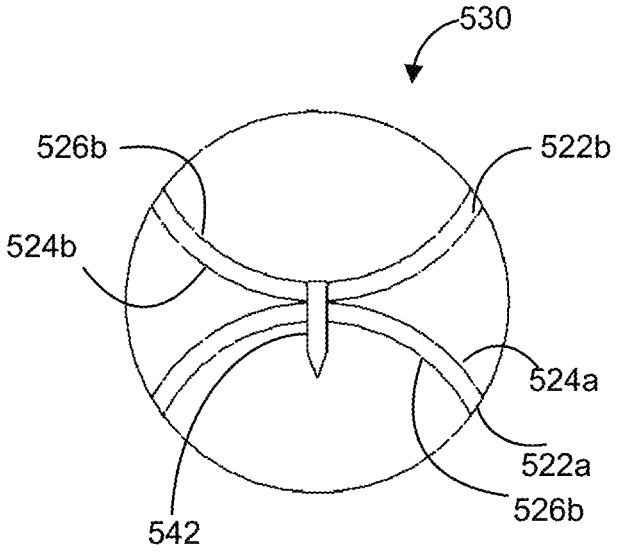
FIG. 6C is a schematic illustration of an enlarged cross-sectional view of a portion of the wellbore casings of FIG. 6A, in accordance with an embodiment.

Referring now to FIG. 6C, shown therein is a schematic illustration of an enlarged cross-sectional view of the example junction 530 of FIG. 6B. As shown in FIG. 6C, each of the electrical conductors 540*a*, 540*b*, 540*c* can be an electrically conducting fastener 542 for securing together a pair of wellbore casings 522*a*, 522*b* of the two or more wellbore casings. For example the electrical conductors 540*a*, 540*b*, 540*c* can be electrically conductive studs that pierce the wellbore casings 522*a*, 522*b* to couple the wellbore casings 522*a*, 522*b* together.

Figure 6D:
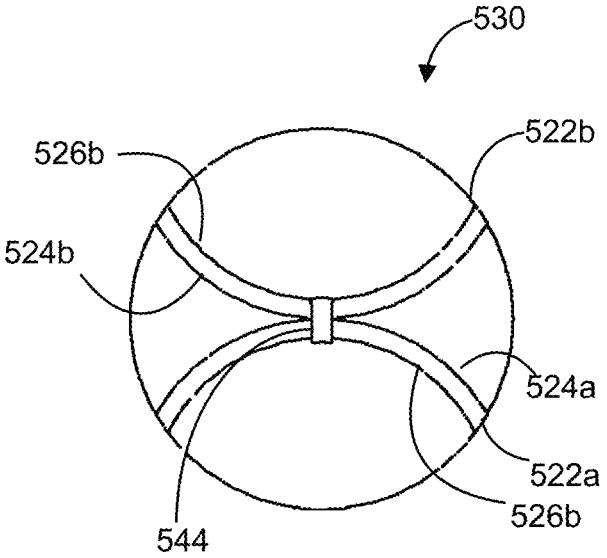
FIG. 6D is another schematic illustration of an enlarged cross-sectional view of a portion of the wellbore casings of FIG. 6A, in accordance with an embodiment.

Referring now to FIG. 6D, shown therein is another schematic illustration of an enlarged cross-sectional view of the example junction 530 of FIG. 6B. As shown in FIG. 6C, when installed from the upper wellbore casing 522*b*, the electrically conducting fastener 542 can protrude from the inner surface of the lower wellbore casing 522*a*. Such protrusions can increase the risk of arcing. The protrusion can be removed or reduced to provide the electrically conducting fastener 544 shown in FIG. 6D.

In some circumstances, it may not be feasible to join the wellbores and/or bring the wellbore casings 522*a*, 522*b* into direct mechanical contact with one another. In at least one embodiment, the wellbores are positioned in proximity to one another at the junction 530 without direct mechanical contact between the wellbore casings 522*a*, 522*b*. Electrically conductive cement can be provided at the junction 530 to act as an electrical conductor. That is, the electrical short 228 can be provided by electrically conductive cement between the wellbore casings 522*a*, 522*b*.

Electrically conductive cements such as cement can have conductivity of up to 100 S/m and are commercially available. Although the conductivity of electrically conductive cement is not as high as the conductivity of metal, the large volume of electrically conductive cement and the relative proximity between wellbore casings 522*a*, 522*b* can be sufficient to provide adequate conductivity. In at least one embodiment, the electrically conductive cement can be further enhanced with additives. For example, carbon nanotubes can be added to the electrically conductive cement to further improve the conductivity of the electrically conductive cement.

In at least one embodiment, the electrical short 228 can be provided by both direct mechanical contact between the wellbore casings 522*a*, 522*b* as well as electrically conductive cement.

In at least one embodiment, an electrically conductive tubing joint can act as an electrical conductor to provide a short circuit between two wellbores that are positioned in proximity to one another without direct mechanical contact between the wellbore casings 522*a*, 522*b*. That is, instead of enlarging one of the two wellbores to join together and allow the wellbore casings 522*a*, 522*b* to be in direct mechanical contact, a lateral wellbore can be drilled to crossover with each of the two wellbores. The lateral wellbore can crossover each of the two wellbores at approximately a 30 to 90 degree angle at the joint. In at least one embodiment, the lateral wellbore can connect more than two wellbores.

Figure 7:
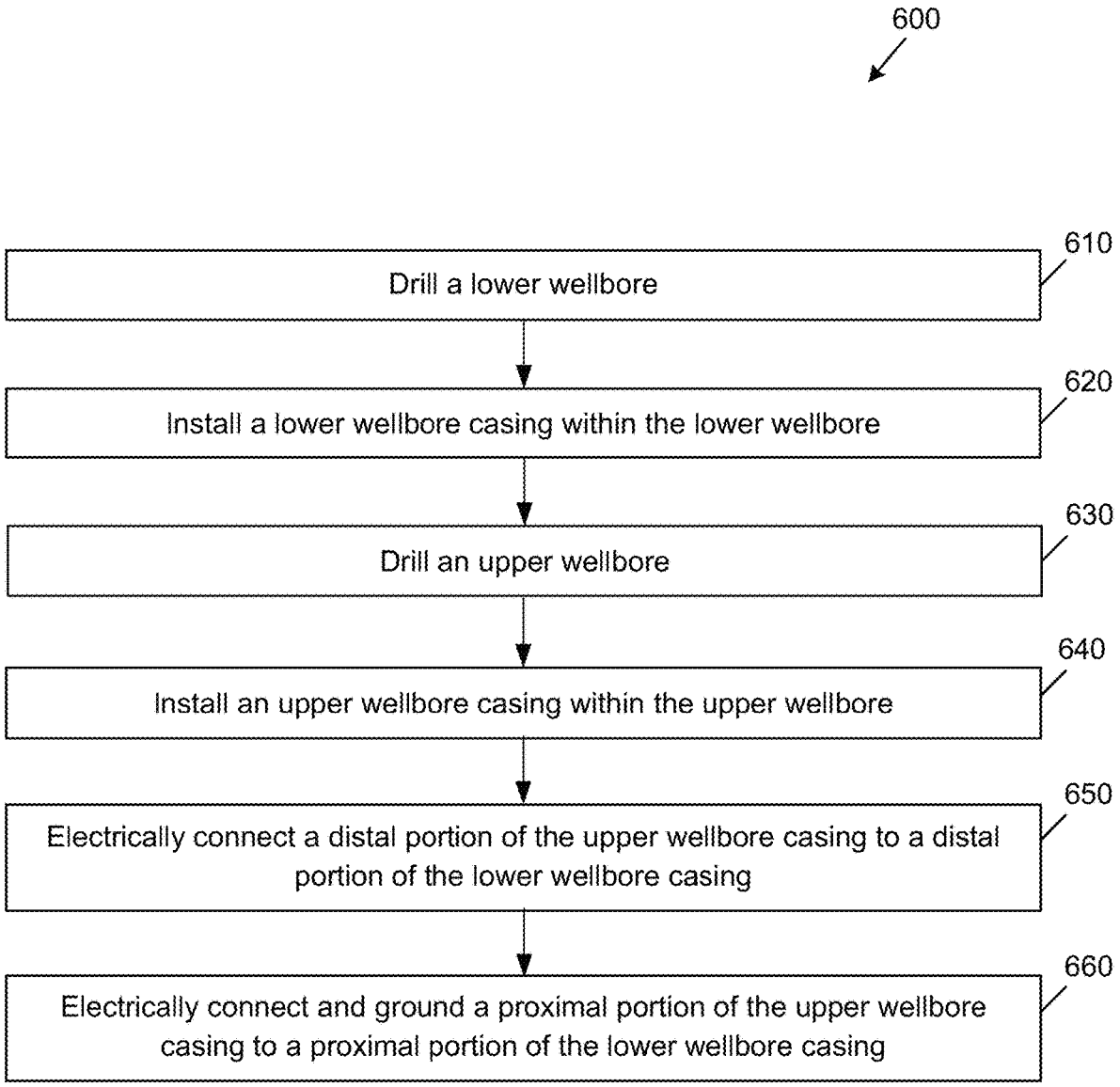
FIG. 7 is a flow chart of an example method of providing wellbores for electromagnetic heating of an underground hydrocarbon formation, in accordance with an embodiment.

Referring now to FIG. 7, shown therein is a flow chart of an example method of providing wellbores for electromagnetic heating of an underground hydrocarbon formation positioned below a ground surface, in accordance with an embodiment. To assist with the description of the method 600, reference will be made simultaneously to FIGS. 8A to 8E.

Figure 8B:
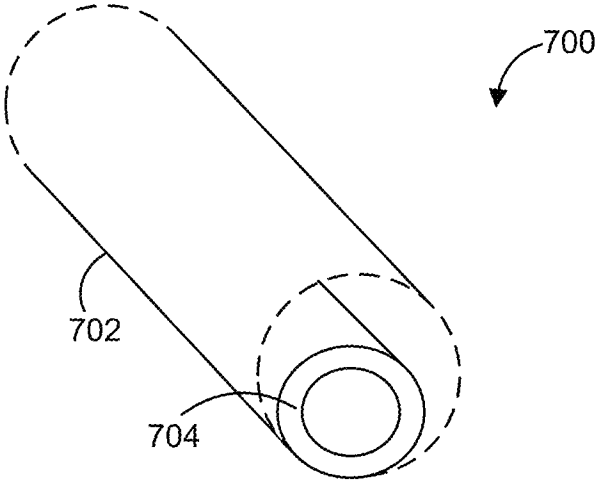
FIG. 8B is a schematic illustration of a portion of a wellbore casing within the lower wellbore of FIG. 8A, in accordance with an embodiment.
Figure 8C:
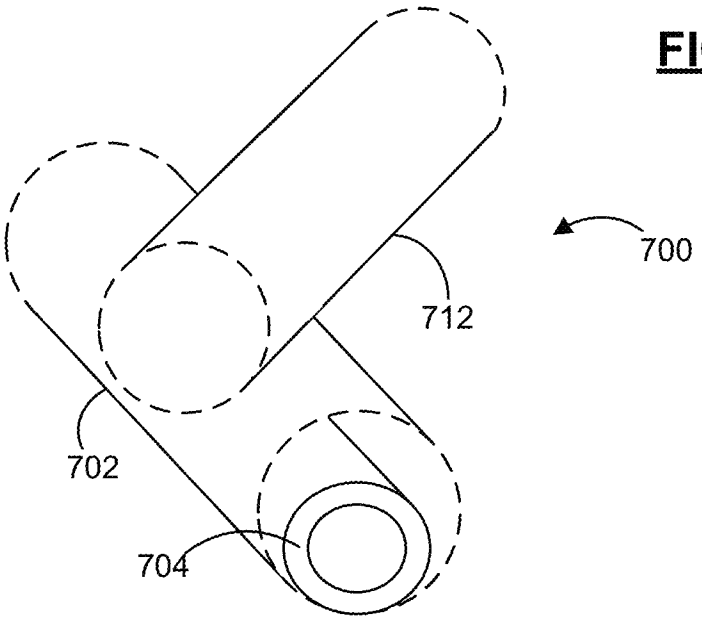
FIG. 8C is a schematic illustration of a portion of an upper wellbore and the lower wellbore of FIG. 8B, in accordance with an embodiment.
Figure 8A:
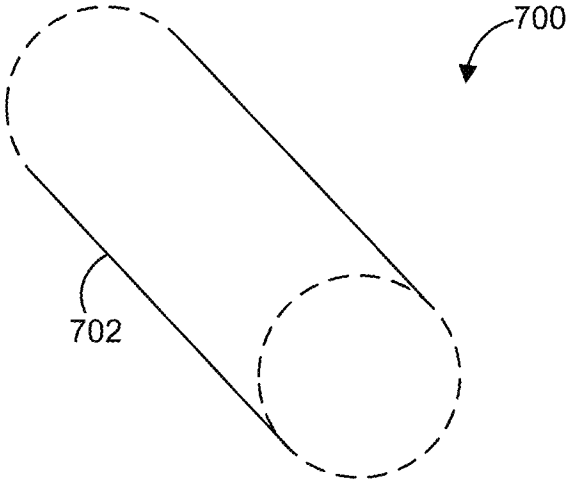
FIG. 8A is a schematic illustration of a portion of a lower wellbore, in accordance with an embodiment.

At 610, a lower wellbore 702 is drilled. It should be noted that while the lower wellbore 702 at junction 700 is shown in FIG. 8A as being substantially horizontal with respect to the surface 104, the lower wellbore 702 can be and/or include portions that are substantially vertical and/or angled with respect to the surface 104.

At 620, a lower wellbore casing 704 is installed within the lower wellbore 702. The lower wellbore casing 704 has a proximal portion at the proximal end of the lower wellbore 702 and a distal portion at the distal end of the lower wellbore 702. FIG. 8B shows a schematic illustration of a portion of the lower wellbore casing 704 installed within the portion of the lower wellbore 702 at junction 700 of FIG. 8A, in accordance with an embodiment.

At 630, an upper wellbore 712 is drilled. The upper wellbore 712 is drilled to be in proximity to the lower wellbore 702 at junction 700. It should be noted that while the upper wellbore 712 is shown in FIG. 8C as being substantially horizontal with respect to the surface 104, the upper wellbore 712 can be and/or include portions that are substantially vertical and/or angled with respect to the surface 104.

In at least one embodiment, at least one of the two or more wellbores 702, 712 can be enlarged at junction 700 to join the two or more wellbores 702, 712 together. For example, at least a lower portion 718 of the upper wellbore 712 can be enlarged in a downward direction at junction 700 to join together with an upper portion 708 of the lower wellbore 702. The lower portion 718 of upper wellbore 712 can be enlarged by reciprocating a drill string 710 or the upper wellbore casing 714 (shown in FIG. 7E) in a longitudinal direction 730 (i.e., a direction parallel to the surface 104). In at least one embodiment, one or more outwardly protruding scrapers 720 can be attached or coupled to the drill string 710 or the upper wellbore casing 714 to increase the radial span and the cutting action radially downwards. In addition, the lower portion 718 of upper wellbore 712 can be enlarged by rotating 732 the upper wellbore casing 714 or a drill string 710 about the longitudinal axis of the upper wellbore 704. In at least one embodiment, the lower portion 718 of upper wellbore 712 can be enlarged by underreaming and/or hydraulic jetting the hydrocarbon formation 102.

Figure 8E:
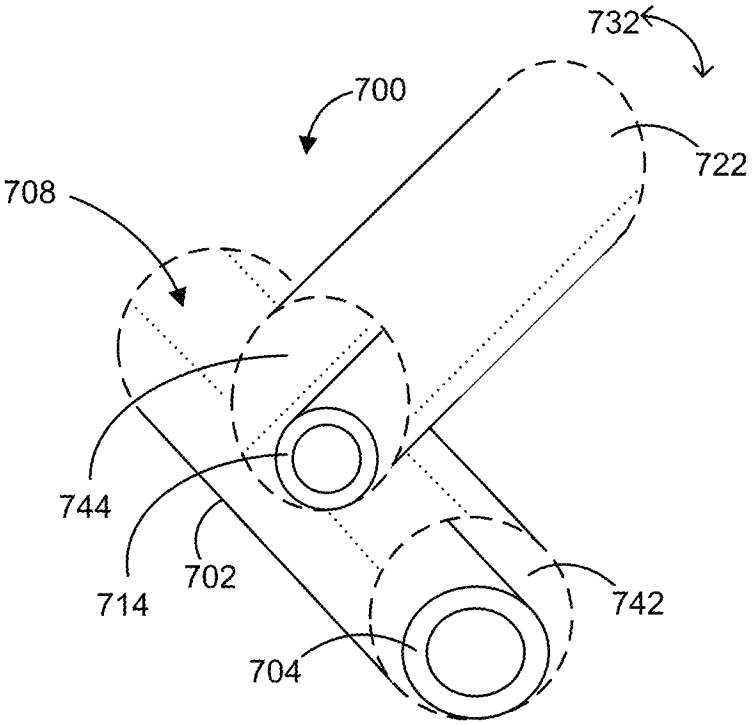
FIG. 8E is a schematic illustration of a portion of a wellbore casing within the enlarged upper wellbore of FIG. 8D, in accordance with an embodiment.
Figure 8D:
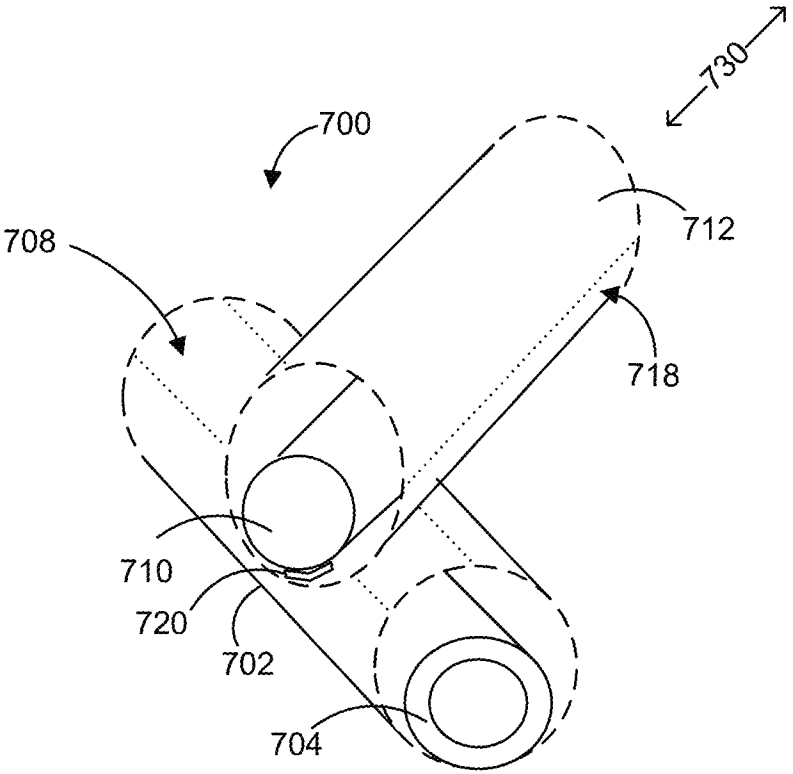
FIG. 8D is a schematic illustration of a portion of an enlargement of the upper wellbore of FIG. 8C, in accordance with an embodiment.

At 640, an upper wellbore casing 714 is installed within the upper wellbore 712, 722. The upper wellbore casing has a proximal portion at the proximal end of the lower wellbore and a distal portion at the distal end of the lower wellbore. While FIG. 8E shows a schematic illustration of a portion of a upper wellbore casing 714 installed within the portion of the upper wellbore 722 at junction 700 of FIG. 8D, in some embodiments, the upper wellbore casing 714 is installed within the upper wellbore 712 that has not been enlarged.

At 650, the distal portion of the upper wellbore 712 is electrically connected to the distal portion of the lower wellbore 702. One or more electrical conductors can be used to electrically connect the distal portion of the upper wellbore 712 to the distal portion of the lower wellbore 702. In at least one embodiment, a non-cement based fluid can be injected in an interstitial space between the lower wellbore 702 and the lower wellbore casing 704 at junction 700 to facilitate installation of the one or more electrical conductors by displacing cement.

In at least one embodiment, the one or more electrical conductors can be, for example, electrically conducting fasteners such as electrically conductive studs 540 that secure the lower wellbore casing 704 and the upper wellbore casing 714 together. The one or more electrically conducting fasteners can be installed using an explosive charge, hydraulic insertion, and/or drilling and tapping. Furthermore, the electrical conductor within the lower wellbore casing 704 can be milled to reduce protrusions of the electrical conductor from an inner surface of the lower wellbore casing 704.

In at least one embodiment, electrically conductive cement can be used to fill an interstitial space 742 between the lower wellbore 702 and the lower wellbore casing 704 at junction 700 and an interstitial space 744 between the upper wellbore 712 and the upper wellbore casing 714 at junction 700. An additive such as but not limited to carbon nanotubes can be added to the electrically conductive cement to enhance conductivity.

At 660, the proximal portion of the upper wellbore casing 714 is electrically connected and grounded to the proximal portion of the lower wellbore casing 712. In at least one embodiment, an electrical cable can be used to connect the proximal portion of the upper wellbore 712 and the proximal portion of the lower wellbore 702 to an output ground of a wave generator 108.

Although FIGS. 8A to 8E show the upper wellbore 712 being drilled after the lower wellbore 702 is drilled, in at least one embodiment, the upper wellbore 712 can be drilled before the lower wellbore 702 is drilled. Furthermore, although FIGS. 8A to 8E show the lower wellbore casing 706 being installed after the lower wellbore 702 is drilled and before the upper wellbore 712 is drilled, in at least one embodiment, the lower wellbore casing 706 can be installed after the upper wellbore 712 is drilled and even after the upper wellbore casing 716 is installed.

Numerous specific details are set forth herein in order to provide a thorough understanding of the exemplary embodiments described herein. However, it will be understood by those of ordinary skill in the art that these embodiments may be practiced without these specific details. In other instances, well-known methods, procedures and components have not been described in detail so as not to obscure the description of the embodiments. Furthermore, this description is not to be considered as limiting the scope of these embodiments in any way, but rather as merely describing the implementation of these various embodiments.

The invention claimed is:

1. An apparatus for electromagnetic heating of an underground hydrocarbon formation positioned below a ground surface, the apparatus comprising:

two or more wellbore casings positioned within two or more wellbores, the two or more wellbores extending from a proximal end at the ground surface to a distal end at the underground hydrocarbon formation, each of the two or more wellbore casings having a proximal portion and a distal portion, the two or more wellbores being in proximity to one another at a junction;

a first electrical connection between the proximal portions of the two or more wellbore casings for grounding the two or more wellbore casings; and a second electrical connection between the distal portions of the two or more wellbore casings to provide a short circuit that reduces current traveling on the two or more wellbore casings to the ground surface, the second electrical connection being located at the junction, and the second electrical connection comprising outer surfaces of at least part of the distal portions of the two or more wellbore casings in direct contact with one another.

2. An apparatus for electromagnetic heating of an underground hydrocarbon formation positioned below a ground surface, the apparatus comprising:

two or more wellbore casings positioned within two or more wellbores, the two or more wellbores extending from a proximal end at the ground surface to a distal end at the underground hydrocarbon formation, each of the two or more wellbore casings having a proximal portion and a distal portion, the two or more wellbores being in proximity to one another at a junction;

a first electrical connection between the proximal portions of the two or more wellbore casings for grounding the two or more wellbore casings; and a second electrical connection between the distal portions of the two or more wellbore casings to provide a short circuit that reduces current traveling on the two or more ore casings to the ground surface, the second electrical connection being located at the junction, wherein at least part of a first wellbore of the two or more wellbores defines a first longitudinal axis extending from the proximal end to the distal end of the first wellbore;

at least part of a second wellbore of the two or more wellbores defines a second longitudinal axis extending from the proximal end to the distal end of the second wellbore; and the second longitudinal axis traverses a projection of the first longitudinal axis at the junction.

3. The apparatus of claim 2, wherein the first longitudinal axis and the second longitudinal axis are substantially horizontal at the junction.

4. The apparatus of claim 2, wherein the second electrical connection comprises one or more electrical conductors.

5. The apparatus of claim 4, wherein the one or more electrical conductors comprise one or more electrically conducting fasteners, each of the fasteners securing a pair of wellbores of the two or more wellbore casings together.

6. The apparatus of claim 4, wherein the second electrical connection further comprises outer surfaces of at least part of the distal portions of the two or more wellbore casings being in contact.

7. The apparatus of claim 2 further comprising electrically conductive cement positioned within an interstitial space between the wellbores and the wellbore casings at the junction.

8. The apparatus of claim 7 further comprising an additive to enhance conductivity of the electrically conductive cement.

9. The apparatus of claim 2, wherein:

each of the two or more wellbore casings terminate at a distal end, the distal ends of the wellbore casings being proximal to the distal ends of the wellbores; and the junction is located substantially near at least one of the distal ends of the two or more wellbore casings.

10. The apparatus of claim 2, wherein at least one of the two or more wellbores are enlarged at the junction to join the two or more wellbores together.

11. The apparatus of claim 10, wherein:

the two or more wellbores comprise a lower wellbore and an upper wellbore; and the at least one of the two or more wellbores being enlarged comprises at least a lower portion of the upper wellbore being enlarged in a downward direction to join with an upper portion of the lower wellbore.

12. The apparatus of claim 2, wherein the two or more wellbores being in proximity to one another at the junction comprises at least a pair of wellbores of the two or more wellbores being laterally spaced less than one meter apart.

13. The apparatus of claim 2, wherein the first electrical connection comprises an electrical cable connected to an output ground of a wave generator.

14. A method of providing wellbores for electromagnetic heating of an underground hydrocarbon formation positioned below a ground surface, the method comprising:

drilling a lower wellbore extending from a proximal end at the ground surface to a distal end at the underground hydrocarbon formation;

installing a lower wellbore casing within the lower wellbore, the lower wellbore casing having a proximal portion and a distal portion;

drilling an upper wellbore extending from a proximal end at the ground surface to a distal end at the underground hydrocarbon formation and being in proximity to the lower wellbore at a junction;

installing an upper wellbore casing within the upper wellbore, the upper wellbore casing having a proximal portion and a distal portion;

electrically connecting the distal portion of the upper wellbore casing to the distal portion of the lower wellbore casing; and electrically connecting and grounding the proximal portion of the upper wellbore casing to the proximal portion of the lower wellbore casing, wherein at least part of the lower wellbore defines a first longitudinal axis extending from the proximal end to the distal end of the lower wellbore;

at least part of the upper wellbore defines second longitudinal axis extending from the proximal end to the distal end of the upper wellbore; and the second longitudinal axis traverses a projection of the first longitudinal axis at the junction.

15. The method of claim 14, wherein the upper wellbore is drilled after the lower wellbore is drilled.

16. The method of claim 14 further comprises enlarging at least a lower portion of the upper wellbore in a downward direction at the junction to join with an upper portion of the lower wellbore together.

17. The method of claim 16, wherein enlarging the upper wellbore in a downward direction comprises reciprocating one of the upper wellbore casing and a drill string in a longitudinal direction.

18. The method of claim 17 further comprises prior to reciprocating, attaching one or more outwardly protruding scrapers to the one of the upper wellbore casing and the drill string to increase a radial span and a cutting action radially downwards during reciprocation.

19. The method of claim 16 wherein enlarging the upper wellbore in a downward direction further comprises rotating one of the upper wellbore casing and the drill string.

20. The method of claim 16, wherein enlarging the upper wellbore comprises underreaming or hydraulic jetting the hydrocarbon formation.

21. The method of claim 14 further comprises using one or more electrical conductors to electrically connect the distal portion of the upper wellbore casing to the distal portion of the lower wellbore casing.

22. The method of claim 21 comprises using a non-cement based fluid to displace cement in an interstitial space between the lower wellbore and the lower wellbore casing at the junction to facilitate installation of the one or more electrical conductors.

23. The method of claim 21 comprises securing the upper wellbore casing to the lower wellbore casing with one or more electrically conducting fasteners.

24. The method of claim 23 comprises installing the one or more electrically conducting fasteners using at least one of an explosive charge, hydraulic insertion, and drilling and tapping.

25. The method of claim 21 comprises milling the electrical conductor within the lower wellbore casing to reduce protrusions of the electrical conductor from an inner surface of the lower wellbore casing.

* * * * *